United States Patent [19]

Maringer et al.

[11] 4,149,884

[45] Apr. 17, 1979

[54] HIGH SPECIFIC STRENGTH POLYCRYSTALLINE TITANIUM-BASED ALLOYS

[75] Inventors: Robert E. Maringer, Worthington; Edward W. Collings, Columbus; Carroll E. Mobley, Jr., Columbus; Harold L. Gegel, Kettering, all of Ohio

[73] Assignee: The United States of America as represented by the Secretary of the Air Force, Washington, D.C.

[21] Appl. No.: 921,139

[22] Filed: Jun. 30, 1978

[51] Int. Cl.[2] ..... C22C 14/00

[52] U.S. Cl. ..... 75/175.5; 148/32

[58] Field of Search ..... 75/175.5; 148/133, 32

[56] References Cited

U.S. PATENT DOCUMENTS

| | | | |
|---|---|---|---|
| 2,884,323 | 4/1959 | Abkowitz et al. | 75/175.5 |
| 2,906,654 | 9/1959 | Abkowitz | 75/175.5 |
| 3,069,259 | 12/1962 | Margolin | 75/175.5 |
| 3,989,514 | 11/1976 | Tanner et al. | 75/175.5 |
| 4,050,931 | 9/1977 | Tanner et al. | 75/175.5 |
| 4,067,732 | 1/1978 | Ray | 75/170 |

*Primary Examiner*—L. Dewayne Rutledge
*Assistant Examiner*—Peter K. Skiff
*Attorney, Agent, or Firm*—Joseph E. Rusz; Cedric H. Kuhn

[57] ABSTRACT

Polycrystalline titanium-based alloys having a high specific strength are formed by the rapid solidification of a melt composition containing about 80 weight percent titanium and specific amounts of aluminum, vanadium, iron and copper. In the form of filaments the alloys are particularly useful as reinforcing agents in composite structures while in the form of powders the alloys are eminently suitable for use in the fabrication of structural components by the application of powder metallurgy technology.

6 Claims, 2 Drawing Figures

HIGH SPECIFIC STRENGTH POLYCRYSTALLINE TITANIUM-BASED ALLOYS

RIGHTS OF THE GOVERNMENT

Figure 1:
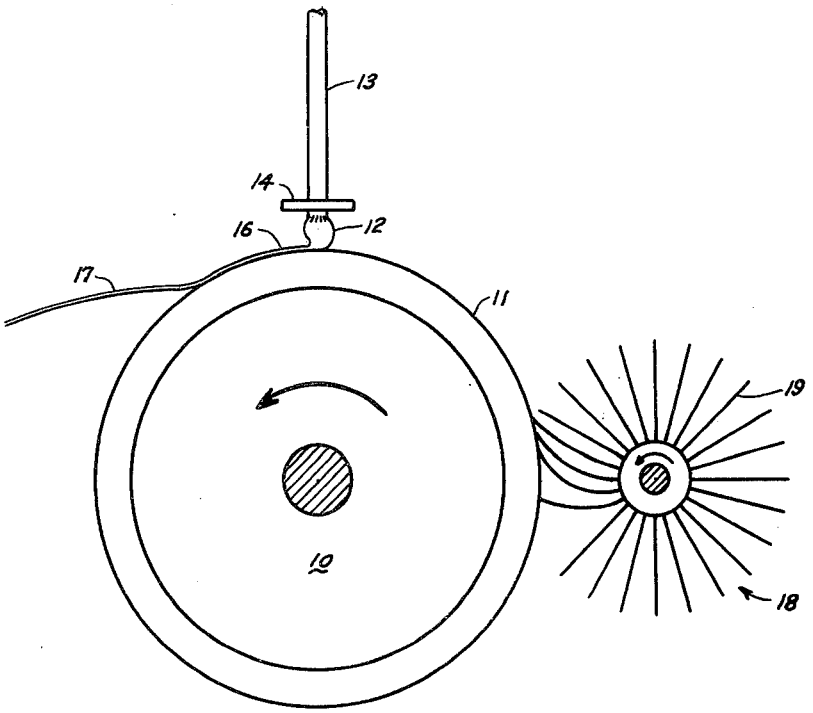

The invention described herein may be manufactured and used by or for the Government of the United States for all governmental purposes without the payment of any royalty.

FIELD OF THE INVENTION

This invention relates to polycrystalline titanium-based alloys which possess a high specific strength.

BACKGROUND OF THE INVENTION

In recent years a large amount of research has been conducted in the development of fiber-reinforced composites for aerospace applications. An air-frame fabricated from a composite or any other material requires a large number of fasteners. Since there is a tendency for cracks to develop at fastener holes, the area in the vicinity of a fastener is of importance from a structural integrity standpoint. The detection of cracks is difficult and in many cases impossible because of component overlap. Accordingly, the prevention of cracks in the first place becomes of vital importance. To this end, some degree of plasticity of the importance. To this end, some degree of plasticity of the material in the vicinity of the fastener hole is a desirable attribute. To be able to take advantage of fiber-reinforced composite materials in air-frame construction, a reinforcing fiber or filament is required that is capable of plastically deforming around the holes so as to minimize the possibility of crack initiation. Graphite and boron fibers, conventionally used as reinforcing agents, do not possess the requisite combination of strength and plasticity.

In engine manufacture the technology is available for fabricating gas turbine compressor blades from graphite and boron fiber-reinforced epoxy resin composites. However, blades made from these materials are incapable of satisfactorily withstanding the impact of foreign objects ingested by the engine. As discussed above, the deficiency is attributable to the lack of important properties in the presently available reinforcing fibers.

In the aerospace industry there is a growing interest in the development of powder metallurgical processes. The present high cost of titanium alloy structural components stems from the large volume of material input in the form of forgings and extrusions for structural components and the associated expense of machining away excess material. Powder metallurgy is a technology that offers a solution to these problems. While significant strides are being made in the area of manufacturing techniques for making shapes from powder, there is a problem in developing a suitable powder that can be compacted, e.g., by vacuum hot pressing or hot isostatic pressing, to provide shapes having superior mechanical properties.

Figure 2:
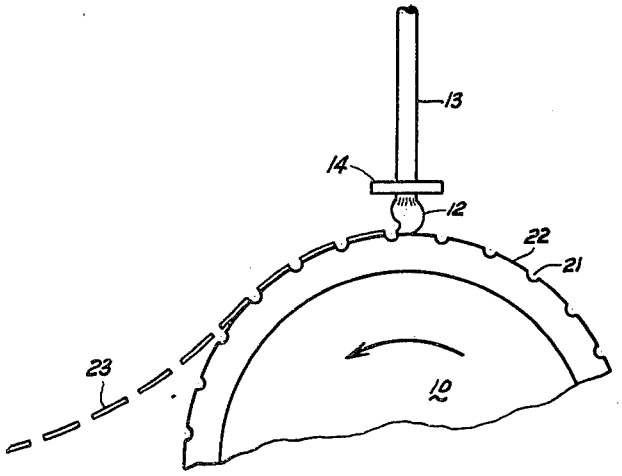

It is a principal object of this invention, therefore, to provide a high specific strength polycrystalline titanium-based alloy which can be in the form of a filament suitable for use in reinforcing composites or in the form of a powder suitable for use in fabricating structures by powder metallurgical processes. Other objects and advantages of the invention will become apparent to those skilled in the art upon consideration of the accompanying disclosure and the drawing, in which:

FIG. 1 is a schematic representation of apparatus that can be used in the preparation of filaments of the alloy of this invention; and FIG. 2 is a modification of the rotating disc shown in FIG. 1 that can be used in preparing powder of the alloy of this invention.

SUMMARY OF THE INVENTION

The present invention resides in a polycrystalline titanium-based alloy possessing a high specific strength, i.e., the ratio of strength to density. The alloy consists essentially of, in weight percentages, 5.4 percent aluminum, 3.6 percent vanadium, 6 to 8 percent iron, 3 to 5 percent copper, and the balance titanium exclusive of any impurities. The titanium alloys normally contains oxygen, nitrogen and carbon as impurities at normal impurity levels. The total amount of impurities is generally no more than 0.5 percent.

The titanium-based alloys of this invention are much stronger than the prior art titanium alloys. Most of the conventional metals and alloys exhibit specific strengths (ratio of strength to density) considerably less than $5 \times 10^6$ cm whereas the instant alloys have a specific strength greater than $5 \times 10^6$ cm, e.g., 5.2 to $5.3 \times 10^6$ cm. The alloys are extremely homogeneous and have a fine (1–5 μm) grain structure, physical states that are conducive to high strength and moduli as well as superplasticity. While certain of the amorphous metallic alloys are reported to have high specific strengths, the polycrystalline alloys of this invention possess a greater ductility and have a higher use temperature.

The homogeneity and fine grain structure of the polycrystalline alloys result from the fact that in their preparation the alloy melt compositions are subjected to rapid solidification. In general, the alloys are solidified or melt-quenched at a quench rate ranging from about $10^{4°}$ C/sec to $10^{6°}$ C/sec. While it is not intended to limit the present invention to any particular method of melt-quenching, it is often preferred to follow the procedure substantially as described in U.S. Pat. No. 3,896,203, issued to two of us, R. E. Maringer and C. E. Mobley, Jr., on July 22, 1975. The procedure disclosed in this patent, referred to herein as the pendant drop melt extraction method, is briefly discussed hereinafter with relation to FIGS. 1 and 2.

In FIG. 1 apparatus is illustrated that can be used to cast polycrystalline alloys of this invention in the form of filaments or ribbons by rapidly quenching the melt composition. A heat extracting member in the form of rotating disc 10 has a V-shaped edge 11. Disc 10 is rotated in the direction indicated by the arrow so as to contact the molten portion 12 or rod 13. Rod 10 is the source material for preparing the alloys of this invention. The rod can be fabricated by arc melting appropriate amounts of the alloy components and drop casting the melt into a rod of suitable diameter and length. Alternatively, the iron and copper alloying materials in the form of wires can be fastened longitudinally to a Ti-6A1-4V rod so as to provide the desired melt composition.

The molten portion 12 of rod 10 in the form of a pendant drop can be conveniently created by heating the end of the rod by means of electron beam filament 14. Energy source other than electron beams that can be used to form the melt zone include oxy-acetylene flames, plasma torches, focused radiant energy, induction heating and laser beams. Disc 10 is formed of a material, such as copper or brass, which has the capacity to remove heat from the molten material at a rate so as to solidify the material in the form of a filament on the circumferential edge.

In operation of the apparatus, edge 11 of rotating disc 10 passes through the surface of the pendant metal drop. On emerging from the droplet, the periphery of the disc carries with it a layer 16 of solidified metal and so extracts it from the melt. As the newly formed length of fiber cools, the bond between it and the disc is broken, enabling it to separate from the disc and become a collectable fiber 17. A rotating wheel 18 having metallic fibers 19 attached to its periphery provides means for cleaning the disc's circumferential edge.

Since the fiber or filament solidifies directly on the disc, any interruption in the continuity of the disc periphery interrupts the continuity of the product. Thus, as shown in FIG. 2, by introducing semi-circular indentations or notches 21 in the circumferential edge of disc 10, fibers of any desired length 22, and consequently length-to-diameter ratio, can be cast. Since fiber particles 23 can have a relatively small length-to-diameter ratio, they can be used as a substitute for conventional powder in powder metallurgy.

A more complete understanding of the invention can be obtained by referring to the following illustrative example which is not intended, however, to be unduly limitative of the invention.

EXAMPLE

A series of runs was conducted in which fibers of polycrystalline titanium-based alloys of this invention were prepared by the pendant drop melt extraction method as described above. A control run was also carried out in which fibers of a polycrystalline titanium-based alloy were prepared that have a composition different from that of the invention alloys.

The components of the alloys were arc melted and drop cast into rods, about 1 cm in diameter and 7 cm in length, suitable for installation in the pendant drop melt extraction apparatus. During preparation of the fibers, the apparatus was maintained under a vacuum. Alloy compositions in weight percent and melt-extraction-disc rim speed are shown below in Table I.

TABLE I

| Alloy | Composition, weight % | Disc Speed m/min |
|---|---|---|
| A | 80 Ti-5.4Al-3.6 V-8 Fe-3Cu | 255–765 |
| B | 80 Ti-5.4Al-3.6 V-6 Fe-5Cu | 215–765 |
| Control | 90 Ti-6Al-4V | 215–765 |

The mechanical properties of the fibers were examined by microhardness measurement and tensile testing. The results are set forth below in Table II.

TABLE II

| Alloy | Vickers Hardness $kg/mm^2$ | Ultimate Tensile Strength, $kg/mm^2$ | Density, $g/cm^3$ | Specific Strength, $10^5$ cm | Young's Moduli, ksi |
|---|---|---|---|---|---|
| A | 588 | 239 | 4.6 | 52.0 | 11.04 |
| B | 542 | 243 | 4.6 | 52.8 | 9.46 |
| Control | — | 87.5 | 4.4 | 19.4 | 13.44 |

As seen from Table II, alloys A and B had high specific strengths whereas that of the control alloy was about 60 percent lower. The reason for this has to do with the differences in ductility. Alloys A and B could be bent through acute angles without breaking. The specific strengths of alloys A and B are much greater than that of the control alloy. Actually, the specific strengths of alloys A and B are greater than that of the strongest known metallic glass ribbon fiber and close to that of Ti-Be-Zr, the metallic glass with the highest known specific strength.

The foregoing data indicate that the rapidly-solidified polycrystalline alloy filaments of this invention are eminently suitable for use as a composite reinforcing agent. Also, the powder prepared from the alloys can be used with advantage in fabricating structural components and engine parts by engine parts by powder metallurgy.

As will be evident to those skilled in the art, modifications of the present invention can be made in view of the foregoing disclosure without departing from the spirit and scope of the invention.

We claim:

1. A polycrystalline titanium-based alloy having a high specific strength consisting essentially of, in weight percentages, 80 percent titanium, 5.4 percent aluminum, 3.6 percent vanadium, 6 to 8 percent iron, and 3 to 5 percent copper.

2. The titanium-based alloy according to claim 1 that is in the form of a filament.

3. The titanium-based alloy according to claim 1 that is in the form of a powder.

4. The titanium based alloy according to claim 1 that has a specific strength greater than $5 \times 10^6$ cm.

5. A polycrystalline titanium-based alloy having a high specific strength formed by rapidly quenching an alloy melt consisting essentially of, in weight percentages, 80 percent titanium, 5.4 percent aluminum, 3.6 percent vanadium, 6 to 8 percent iron, and 3 to 5 percent copper.

6. The polycrystalline titanium-based alloy of claim 5 in which the alloy melt is quenched at a rate ranging from about $10^{4\circ}$ C/sec to $10^{6\circ}$ C/sec.

* * * * *